US006385797B1

(12) United States Patent
Phillips

(10) Patent No.: US 6,385,797 B1
(45) Date of Patent: May 14, 2002

(54) APPARATUS FOR RAISING AND LOWERING A SEAT

(76) Inventor: Barry S. Phillips, 8062 College Corner Rd., Centerville, IN (US) 47330

( * ) Notice: Subject to any disclaimer, the term of this patent is extended or adjusted under 35 U.S.C. 154(b) by 0 days.

(21) Appl. No.: 09/880,646

(22) Filed: Jun. 15, 2001

(51) Int. Cl.[7] ..... A47K 17/00
(52) U.S. Cl. ..... 4/667; 297/DIG. 10
(58) Field of Search ..... 4/667, 254; 297/DIG. 10

(56) References Cited

U.S. PATENT DOCUMENTS 2,954,566 A * 10/1960 Lottenberg ..... 4/254
3,458,872 A * 8/1969 Hellstrom et al. ... 297/DIG. 10
3,851,917 A * 12/1974 Horstmann et al. .. 297/DIG. 10
5,189,739 A * 3/1993 Thierry ..... 4/667
5,561,872 A 10/1996 Phillips
5,661,858 A * 9/1997 House et al. ..... 4/667
5,848,447 A * 12/1998 Lindsay ..... 4/667
6,154,896 A 12/2000 Houston et al.
6,161,229 A 12/2000 Ryan et al.
6,189,164 B1 * 2/2001 Krapu ..... 4/667

* cited by examiner

*Primary Examiner*—Charles H. Eloshway
(74) *Attorney, Agent, or Firm*—Jacox, Meckstroth & Jenkins

(57) ABSTRACT

An upper front annular frame and a lower annular frame have pivotally connected front portions, and a seat overlies the frames and has a rear portion pivotally connected to a rear portion of the upper frame. A pair of scissor linkages are connected to corresponding opposite side portions of the frames and have forwardly projecting arms supporting rollers engaging a bottom surface of the seat. A motor driven screw jack is supported by a bracket mounted on one side portion of the lower frame and is connected to tilt the upper frame between a horizontal position adjacent the lower frame and an elevated inclined position while the scissor linkages automatically move the seat between a horizontal position and an inclined elevated position projecting forwardly of the frames.

23 Claims, 4 Drawing Sheets

42
28
74
10
17
40
92
68
69
67
44
88
18
27
36
31
16
105
104
89
80
15
115
14
99
132

APPARATUS FOR RAISING AND LOWERING A SEAT

BACKGROUND OF THE INVENTION

The present invention relates to a power-assisted device or apparatus for raising and lowering a seat and of the general type disclosed in U.S. Pat. No. 5,561,872 issued to applicant. Such apparatus is particularly useful for raising and lowering a toilet seat having a center opening to assist a handicapped person. For such assistance, it is desirable for the apparatus to move the seat between a horizontal lower seating position and a downwardly inclined elevated or upper position projecting substantially forwardly of the lower position so that it is convenient and natural for the person to move to and from a standing position. It is also desirable to simplify the apparatus to minimize the weight and construction cost of the apparatus while also enabling the apparatus to raise and lower a person having substantial weight, for example, over 250 lbs. Relatively complex different forms of power-assisted toilet seat lift apparatus are disclosed in U.S. Pat. Nos. 6,154,896 and 6,161,229, both of which cite applicant's '872 patent.

SUMMARY OF THE INVENTION

The present invention is directed to an improved apparatus for raising and lowering a seat between a horizontal lower seating position and a downwardly inclined elevated or upper position projecting forwardly of the lower position for assisting a handicapped person, and which is ideally suited for mounting on a toilet for raising and lowering a toilet seat. The apparatus of the invention is simple and economical in construction and is capable of raising and lowering a person having substantial weight. In addition, the apparatus of the invention may be quickly attached to a toilet base after removing the conventional toilet seat and cover, and is compact so that it does not require additional space beyond either side of the toilet water tank.

In accordance with a preferred embodiment of the invention, a lifting apparatus includes an upper support member or frame and a lower support member or frame having corresponding front portions pivotally connected. A seat, such as an annular toilet seat, overlies the frames and has a rear portion pivotally connected to a rear portion of the upper support member or frame. A pair of scissor linkages are connected to corresponding opposite side portions of the frames and have forwardly projecting arms which support rollers engaging the bottom surface of the seat. A reversible motor driven screw jack unit is supported on either side of the frames by a U-shaped support bracket and has a linear movable actuating rod connected to one side portion of the upper frame for tilting or pivoting the upper frame between a horizontal position adjacent the lower frame and an elevated inclined position while the scissor linkages automatically move the seat between a horizontal seating position and an inclined elevated position projecting forwardly of the frames. A U-shaped handle member is mounted on the front portion of the lower frame and has upper handle grips either of which supports a remote control switch for operating the motor driven screw jack unit.

Other features and advantages of the invention will be apparent from the following description, the accompanying drawings and the appended claims.

DESCRIPTION OF THE PREFERRED EMBODIMENT

Figure 1:
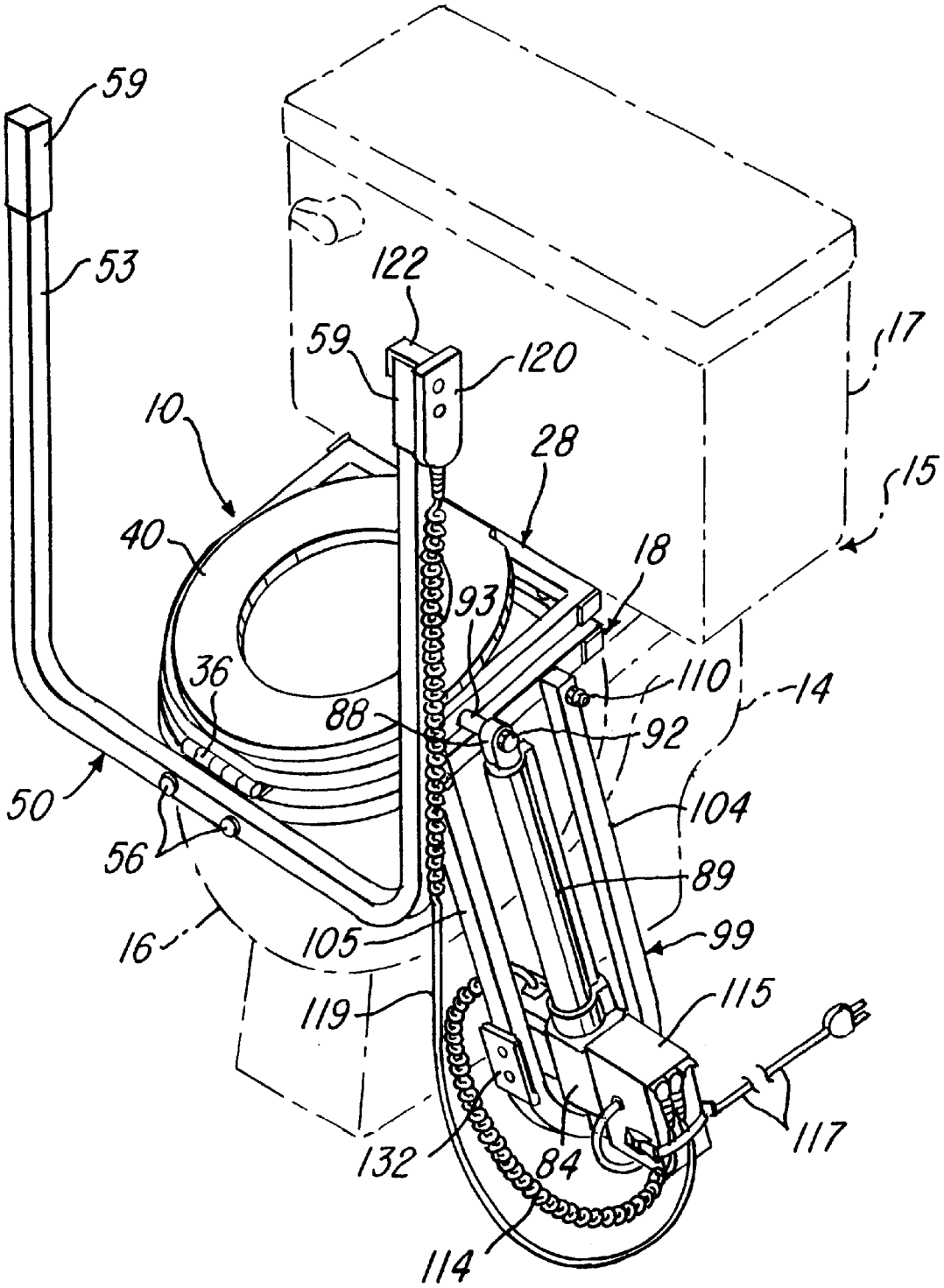
FIG. 1 is a perspective view of apparatus constructed in accordance with the invention and illustrated for raising and lowering a toilet seat, with a conventional toilet shown in phantom.
Figure 2:
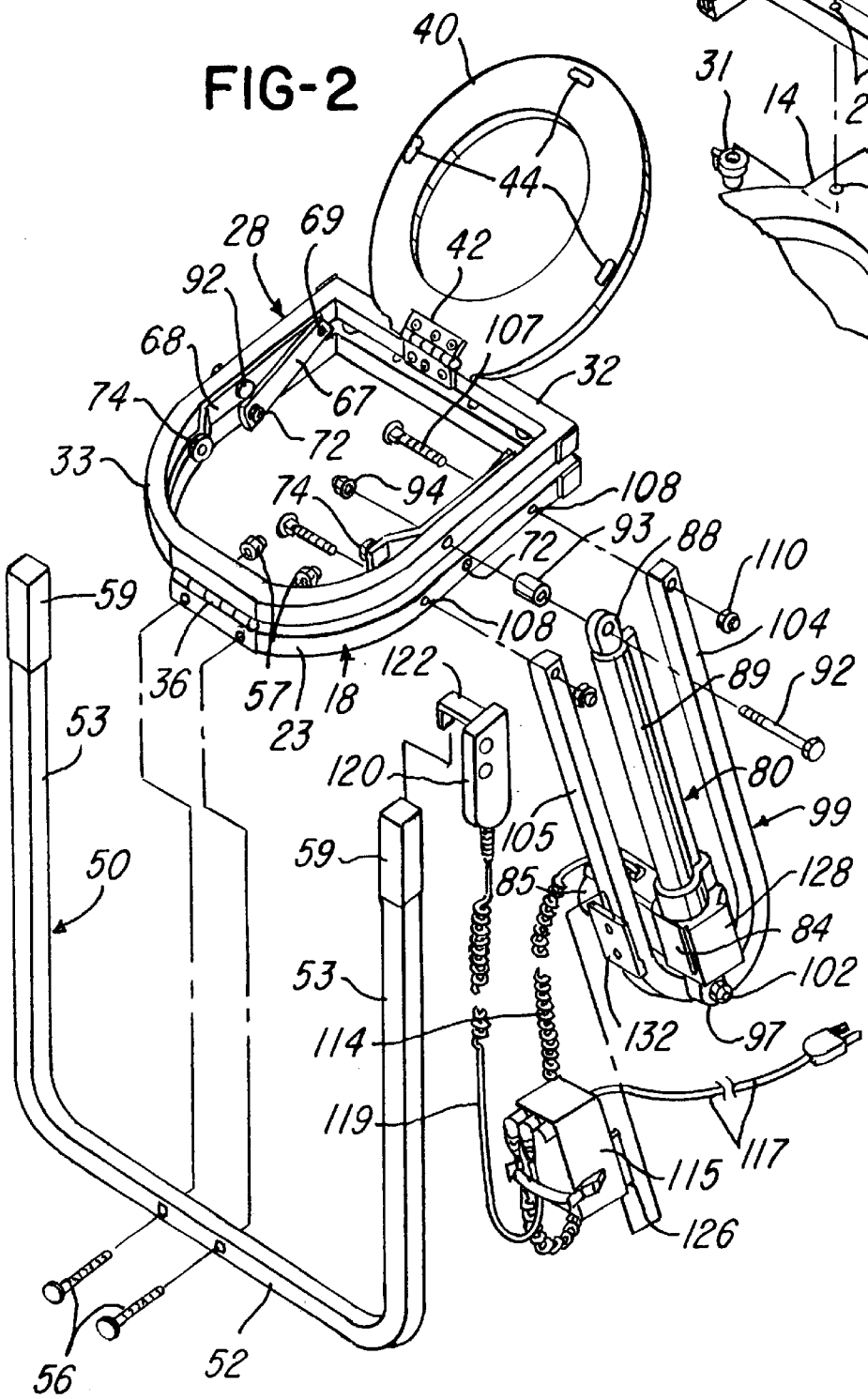
FIG. 2 is a partially exploded perspective view of the apparatus shown in FIG. 1.
Figure 3:
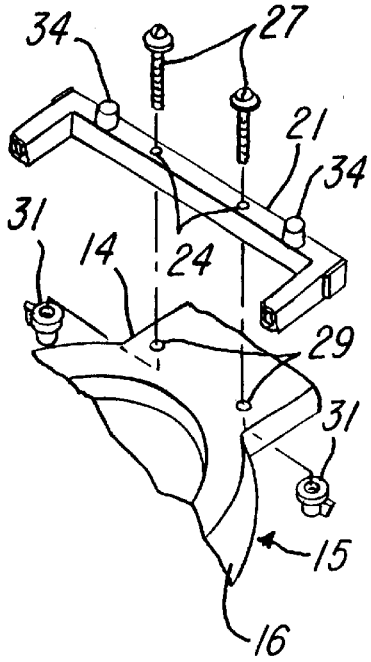
FIG. 3 is a fragmentary perspective view illustrating the mounting of the apparatus on a conventional toilet base.

Referring to FIGS. 1 & 2, a seat raising and lowering apparatus 10 is adapted to mount on a base 14 of a toilet 15 having a bowl portion 16 and water tank 17 mounted on the base 14. The apparatus 10 includes an annular first or lower support member or frame 18 constructed or fabricated of square metal or steel tubing and having a straight rear portion 21 welded to the side portions or legs of a U-shaped portion 23. The straight rear portion 21 has a pair of holes 24 (FIG. 3) which receive a pair of screws 27 for rigidly securing the lower frame 18 to the base 14 of the toilet 15. The conventional toilet seat and cover (not shown) for the toilet 15 are removed, and the screws 27 extend through the toilet seat mounting holes 29 and receive thumb nuts 31 so that the frame 18 rests on the top rim of the toilet bowl 16. A fabricated tubular metal second or upper support member or frame 28 has the same configuration as the lower frame 18 and includes a straight rear portion 32 welded to a U-shaped portion 33. The upper frame 28 is spaced slightly above the frame 18 by a pair of resilient or rubber stops 34 mounted on the lower frame rear portion 21 and by a hinge 36 which connects the front portions of the frames 18 and 28. The hinge 36 provides for tilting the upper frame 28 from a horizontal position parallel to the frame 18 and an inclined angular position (FIG. 7) forming an angle of about 60° with respect to the frame 18 mounted on the bowl 16.

A seat member in the form of an annular toilet seat 40 is pivotally connected to the rear portion 32 of the upper frame 28 by a hinge 42, and a set of bumper pads 44 are attached to the underneath surface of the seat 40 and cooperate with the hinge 42 to support the seat 40 in a horizontal position (FIG. 1) with the seat 40 space slightly above the upper frame 28. A U-shaped handle member 50 is also fabricated from square metal or steel tubing and has a horizontal base portion 52 integrally connecting a pair of upwardly projecting vertical arms 53. The base portion 52 of the handle member 50 is rigidly secured to the front of the lower frame 18 by a pair of bolts or screws 56 which extend through corresponding holes within the lower frame 18 and receive corresponding nuts 57. A pair of resilient handle grips 59 are mounted on the upper end portions of the arms 53 and provide for assisting and stabilizing a person using the apparatus, as will be explained later.

Figure 4:
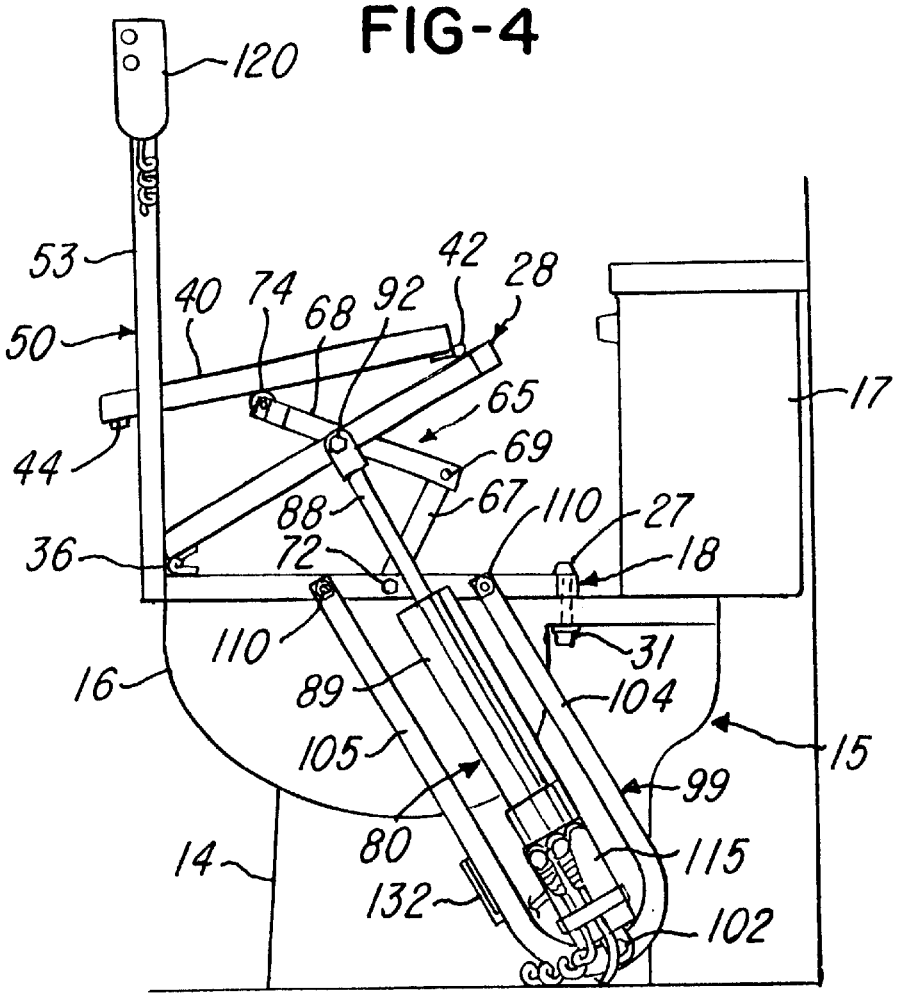
FIG. 4 is a side elevational view of the apparatus shown in FIG. 1 and with the toilet seat partially elevated.
Figure 5:
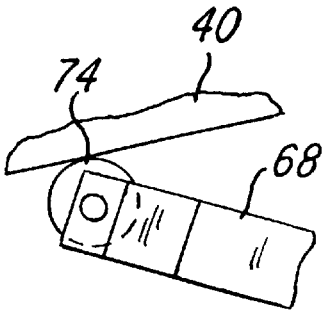
FIG. 5 is an enlarged fragmentary view of the toilet seat and support arm shown in FIG. 4.
Figure 7:
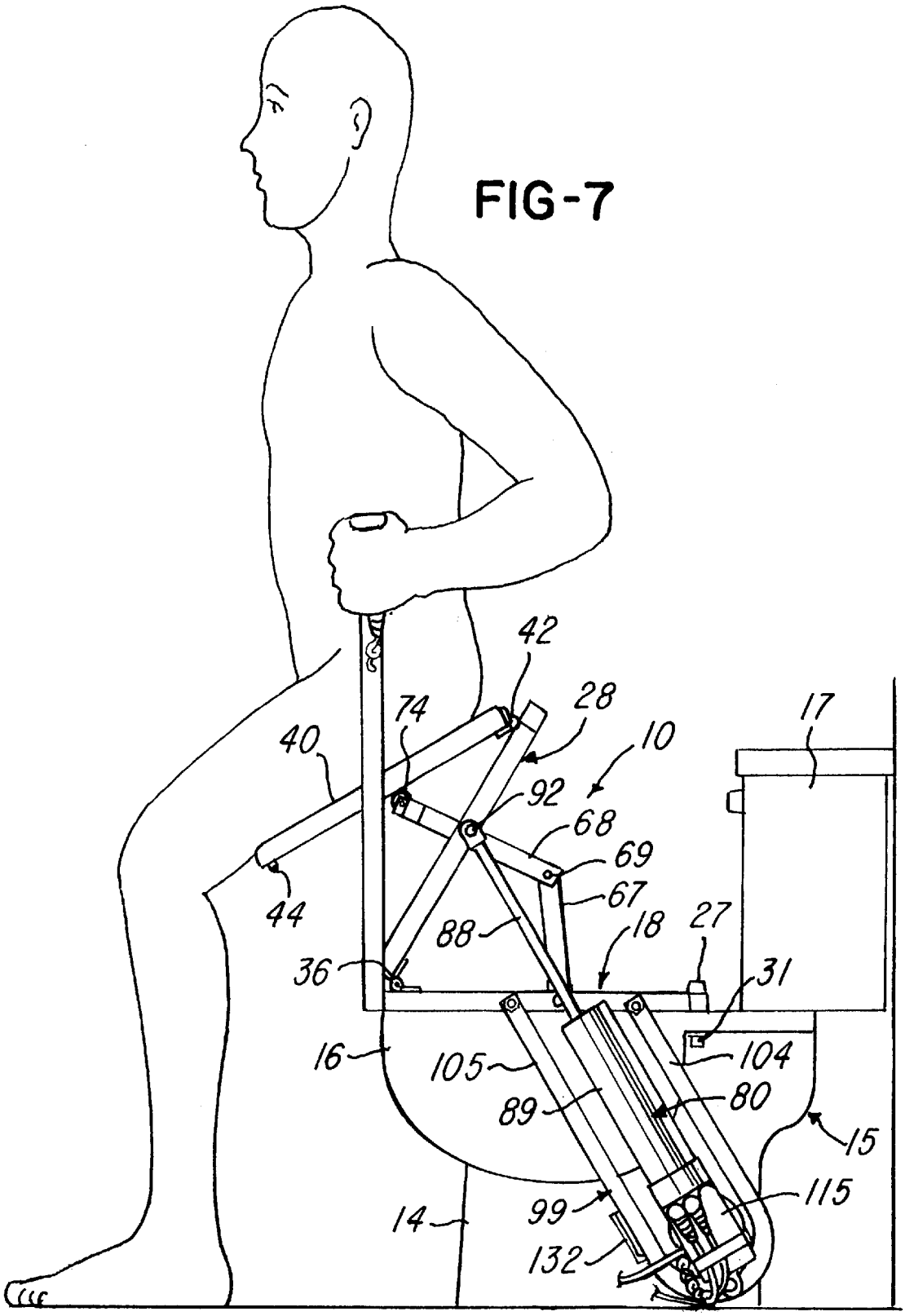
FIG. 7 is a side elevational view similar to FIG. 4 and showing the apparatus extended with the seat in its downwardly inclined upper position projecting forwardly of the toilet and support frames.

The opposite corresponding side portions of the lower frame 18 and upper frame 28 are interconnected by a pair of lever systems or scissor linkages 65 (FIG. 4) each of which includes a set of levers or links 67 and 68 pivotally connected by a fastener such as a rivet or screw 69. The opposite end of each lever or link 67 is pivotally connected to the corresponding side portion of the lower frame 18 by a fastener such as a rivet or screw 72, and the opposite or forward end portion of each lever or link 68 supports a roller 74 (FIG. 5) which contacts the bottom surface of the seat 40, as also shown in FIGS. 4 & 7. Thus when the upper frame 28 is pivoted from its horizontal lower position (FIGS. 1 & 2) to an upwardly and rearwardly projecting inclined position (FIG. 7), the lever system or scissor linkages 65 is effective to move the seat automatically from its horizontal lower position (FIG. 1) to a forwardly projecting and downwardly inclined upper position (FIG. 7) through an intermediate position (FIG. 4).

The movement of the seat 40 between its lower position (FIG. 1) and its upper position (FIG. 7) is produced by a power assist, preferably in the form of a motor driven screw jack 80 similar to the screw jack 80 described in above-mentioned U.S. Pat. No. 5,561,872, the disclosure of which is incorporated by reference. The screw jack unit 80 includes an elongated screw (not shown) which is driven by a gear reducer 84 driven by a reversible electric motor 85. A tubular actuator rod 88 has internal threads which receive the screw, and the rod extends from the upper end of a tubular protective housing 89. The actuator rod 88 has an upper end fitting which is pivotally connected to the side portion of the upper frame 28 by a pivot connection in the form of a bolt 92, a tubular spacer 93 and a nut 94 (FIG. 2).

A mounting lug 97 projects from the bottom of the gear reducer 84 and is pivotally connected to a U-shaped tubular metal support frame or bracket 99 by a pivot connection in the form of a bolt 102. The U-shaped support bracket 99 has upwardly projecting inclined legs 104 and 105 which have upper end portions rigidly secured to the side portion of the lower frame 18 by a pair of bolts 107 (FIG. 2). The bolts 107 extend through corresponding holes 108 within the lower frame 18 and receive corresponding lock nuts 110. The opposite or right side portions of the lower frame 18 and upper frame 28 also have a set of holes for receiving the bolts 92 and 107 so that the support frame or bracket 99 and screw jack 80 may be alternately mounted on the right side of the frames 18 and 28.

Figure 6:
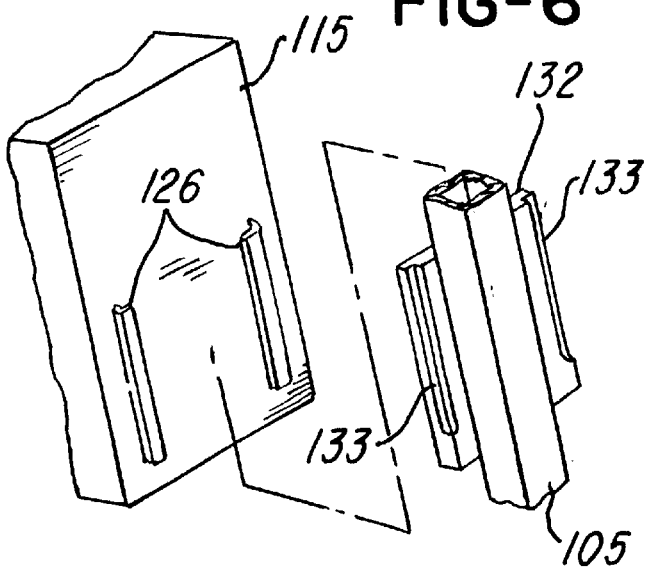
FIG. 6 is a fragmentary exploded view of an alternate support for the control unit shown in FIGS. 1 & 2.

The reversible electric motor 85 is connected by a flexible power cord 114 to a control box or unit 115 from which extends an electrical power supply cord 117 and a flexible cord 119 to a remote hand control switch 120 having push buttons for selectively reversing the motor 85 to extend and retract the actuator rod 88 of the screw jack 80. A U-shaped attachment bracket or clip 122 extends from the upper end of the remote hand control switch 120 for selectively mounting the control switch on either of the handle grips 59 with a light press-fit. Referring to FIG. 6, the rear wall of the control unit 115 has a pair of parallel-spaced tracks 126 which slidably and releasably connect with corresponding undercut grooves within a side housing portion 128 of the gear reducer 84 so that the control unit 115 may be mounted directly on the screw jack unit 80 and project laterally therefrom, as shown in FIG. 1. As an alternative, the control unit 115 may be attached to the inclined leg 105 of the support frame or bracket 99 by a plate 132 (FIG. 6) having opposite undercut grooves 133 for slidably receiving the tracks 126. In this position, the control unit 115 projects downwardly and forwardly from the support frame 99, as illustrated in FIG. 2. This position of the control unit 115 is desirable when there is a small space between the toilet base 14 and an adjacent wall or cabinet.

From the drawings and the above description, it is apparent that seat raising and lowering apparatus constructed in accordance with the present invention, provides desirable features and advantages. For example, the apparatus is simple, durable and economical in construction and is effective to raise and lower the seat 40 and a person resting on the seat between a horizontal seating position as shown in FIG. 1, and an elevated position where the seat is inclined downwardly and projects forwardly from the frames 18 and 28, as shown in FIG. 7. In this elevated position, the person may move more easily to and from a standing position. The apparatus is also compact and requires little space on either side of the toilet base 15 so that the screwjack 80 does not project laterally beyond the width of the toilet tank 16. The U-shaped handle member 50 may also be used to stabilize a person moving between a standing position and a seated position, and the remote control switch 120 may be located on either hand grip 59 for operation by either hand. It is also apparent that by removing the handle member 50 and the screw jack 80 and its supporting bracket 99, all of the components of the apparatus may be placed in a container having a thickness of only a few inches for shipping and storage. It is further apparent from FIGS. 1 & 2, that the toilet 15 may also be used by a non-handicapped person and without using the apparatus attached to the toilet.

While the form of apparatus herein described constitutes a preferred embodiment of the invention, it is to be understood that the invention is not limited to this precise form of apparatus, and that changes may be made therein without departing from the scope and spirit of the invention as defined in the appended claims. For example, it is within the scope of the invention to use another form of power assist in place of the screw jack 80, such as one or two pneumatic springs as disclosed in U.S. Pat. No. 6,035,462. The apparatus may also be used in combination with a conventional chair for raising and lowering a seat cushion. For such use, the annular toilet seat 40 would be replaced by a solid seat panel which carries a seat cushion, and the rear portion of the lower support member or frame 18 would be attached to the chair. The frames 18 and 28 may also be replaced by solid support panels having parallel spaced slots for receiving the scissor linkages.

What is claimed is:

1. Apparatus for raising and lowering a seat member to assist a handicapped person, comprising a first support member and a second support member each having a front portion and a rear portion, a pivot connection pivotally connecting said front portions of said first and second support members, a seat member having a rear portion pivotally connected to said rear portion of said second support member, a scissor linkage pivotally connected to said first and second support members and having a forwardly projecting arm portion positioned to support an intermediate portion of said seat for relative parallel movement, a power assist connecting said first and second said support members and effective to pivot said second support member between a retracted position generally parallel to said first support member and an elevated positioned inclined relative to said first support member, and said scissor linkage being effective to move said seat member automatically between a generally horizontal lower position adjacent said support members and an inclined elevated position projecting forwardly of said support members in response to pivoting of said second support member.

2. Apparatus as defined in claim 1 and including a U-shaped handle member mounted on said front portion of said first support member and having handle grip portions disposed above said seat member.

3. Apparatus as defined in claim 1 wherein said power assist comprises a motor driven screw jack unit connecting a side portion of said first support member to a corresponding side portion of said second support member.

4. Apparatus as defined in claim 3 and including a support bracket having an upper portion mounted on said side portion of said first support member and a lower portion pivotally supporting said screw jack unit.

5. Apparatus as defined in claim 4 wherein said support bracket comprises a U-shaped bracket having spaced leg portions receiving said screw jack unit therebetween.

6. Apparatus as defined in claim 3 and including an electrical control unit for said screw jack unit and having a remote electrical control switch for said unit.

7. Apparatus as defined in claim 1 wherein each of said support members comprises a rigid tubular metal annular frame.

8. Apparatus as defined in claim 7 and including fasteners for removably attaching said rear portion of said first annular frame to a toilet bowl, and said seat member comprises a toilet seat having a center opening.

9. Apparatus as defined in claim 1 and including a roller mounted on said forwardly projecting arm portion of said scissor linkage and engaging an underneath surface of said seat member.

10. Apparatus as defined in claim 1 wherein said first and second support members have corresponding opposite side portions, and each of said corresponding side portions of said support members is connected by a corresponding said scissor linkage.

11. Apparatus for raising and lowering a seat member to assist a handicapped person, comprising a first annular frame and a second annular frame each having a front portion, a rear portion and opposite side portions, a pivot member pivotally connecting said front portions of said first and second frames, a seat having a rear portion pivotally connected to said rear portion of said second frame, a pair of scissor linkages pivotally connected to said side portions of said first and second frames and having forwardly projecting arm portions positioned to support an intermediate portion of said seat for relative movement, a power assist connecting said side portions of said first and second frames for pivoting said second frame from a retracted position generally parallel to said first frame to an elevated position inclined relative to said first frame, and said scissor linkages being effective to move said seat automatically between a generally horizontal lower position adjacent said frames and an inclined elevated position projecting forwardly of said frames.

12. Apparatus as defined in claim 11 and including a U-shaped handle member mounted on said front portion of said first frame and having handle grip portions disposed above said seat.

13. Apparatus as defined in claim 11 wherein said power assist comprises a motor driven screw jack unit supported by a bracket connected to one of said side portions of said first frame and having a linear movable actuator connected to a corresponding said side portion of said second frame.

14. Apparatus as defined in claim 13 and including an electrical control unit for said screw jack unit and having a remote electrical control switch for said unit.

15. Apparatus as defined in claim 11 wherein each of said frames comprises a rigid tubular metal annular frame.

16. Apparatus as defined in claim 15 and including a U-shaped tubular metal support bracket having legs with upper portions mounted on one of said side portions of said first frame and a lower portion pivotally supporting a screw jack unit forming said power assist.

17. Apparatus as defined in claim 11 and including fasteners for removably attaching said rear portion of said first frame to a toilet bowl, and said seat comprises a toilet seat having a center opening.

18. Apparatus as defined in claim 11 and including a roller mounted on each of said forwardly projecting arm portions of said scissor linkages and engaging an underneath surface of said seat.

19. Apparatus for raising and lowering a seat member to assist a handicapped person, comprising a lower annular frame and an upper annular frame each having a front portion, a rear portion and opposite side portions, a pivot member pivotally connecting said front portions of said lower and upper frames, an annular toilet seat having a rear portion pivotally connected to said rear portion of said upper frame, a pair of scissor linkages pivotally connected to said side portions of said lower and upper frames and having forwardly projecting arm portions supporting rollers positioned to support an intermediate portion of said seat for relative movement, a motor drive screw jack connecting corresponding said side portions of said lower and upper frames for pivoting said upper frame between a retracted position generally parallel to said first frame and an elevated position inclined relative to said lower frame, and said scissor linkages being effective to move said seat automatically between a generally horizontal lower position adjacent said frames and an inclined elevated position projecting forwardly of said frames.

20. Apparatus as defined in claim 19 and including a U-shaped handle member mounted on said front portion of said lower frame and having handle grip portions disposed above said seat.

21. Apparatus as defined in claim 19 wherein said motor driven screw jack unit is supported by a bracket connected to one of said side portions of said lower frame and having a linear movable actuator connected to a corresponding said side portion of said upper frame.

22. Apparatus as defined in claim 19 wherein each of said frames comprises a rigid tubular metal annular frame.

23. Apparatus as defined in claim 19 and including fasteners extending through holes within said rear portion of said lower frame for attaching said lower frame to a toilet bowl.

* * * * *